US008550574B2

(12) United States Patent
Jensen et al.

(10) Patent No.: US 8,550,574 B2
(45) Date of Patent: Oct. 8, 2013

(54) MODULAR EXHIBIT STRUCTURE

(75) Inventors: David Christian Jensen, Vancouver (CA); Alexander Renowitzky, Vancouver (CA); Vlado Radanovic, West Kelowna (CA)

(73) Assignee: Logic Exhibit System Ltd., Vancouver (CA)

( * ) Notice: Subject to any disclaimer, the term of this patent is extended or adjusted under 35 U.S.C. 154(b) by 213 days.

(21) Appl. No.: 12/499,296

(22) Filed: Jul. 8, 2009

(65) Prior Publication Data

US 2011/0005692 A1 Jan. 13, 2011

(51) Int. Cl.
*A47F 3/00* (2006.01)

(52) U.S. Cl.
USPC ..... 312/114; 160/135

(58) Field of Classification Search
USPC ..... 312/265.1–265.4, 140, 114, 351; 160/135, 181; 52/36.1–36.6, 238.1, 52/239, 481.2, 455–458, 656.1–656.9, 52/645; 40/605, 606.13, 733
See application file for complete search history.

(56) References Cited

U.S. PATENT DOCUMENTS

| | | | | | |
|---|---|---|---|---|---|
| 1,870,534 | A | | 8/1932 | Skoogh | |
| 2,722,468 | A | * | 11/1955 | Perrin | 312/265.2 |
| 3,316,041 | A | | 4/1967 | Nelson | |
| 3,346,310 | A | * | 10/1967 | Diack | 312/140 |
| 3,347,609 | A | * | 10/1967 | Mann | 312/263 |
| 3,347,610 | A | * | 10/1967 | Pilliod | 312/263 |
| 3,404,931 | A | * | 10/1968 | Fall et al. | 312/265.4 |
| 3,465,487 | A | * | 9/1969 | Coste et al. | 52/241 |
| 3,598,464 | A | * | 8/1971 | Moroziuk | 312/217 |
| 3,762,116 | A | * | 10/1973 | Anderson et al. | 52/239 |
| 3,857,622 | A | * | 12/1974 | Mohr et al. | 312/265.6 |
| 3,869,992 | A | * | 3/1975 | Kramer | 108/60 |
| 4,021,089 | A | * | 5/1977 | Bush | 312/265.5 |
| 4,094,113 | A | | 6/1978 | Good | |
| 4,123,129 | A | * | 10/1978 | Butler | 312/265.3 |
| 4,161,089 | A | | 7/1979 | Omansky | |
| 4,186,533 | A | * | 2/1980 | Jensen | 52/184 |
| 4,204,375 | A | | 5/1980 | Good | |
| 4,381,876 | A | * | 5/1983 | Fenwick | 312/114 |
| 4,566,211 | A | * | 1/1986 | Gustafson et al. | 40/605 |
| 4,641,468 | A | | 2/1987 | Slater | |

(Continued)

FOREIGN PATENT DOCUMENTS

| | | |
|---|---|---|
| CA | 1071375 | 2/1980 |
| CA | 1085570 | 9/1980 |

(Continued)

OTHER PUBLICATIONS

Mila-wall. Versatile Walls for Museums, Galleries and Art Exhibitions. MBA Design & Display Products Corp. [Brochure].

(Continued)

*Primary Examiner* — Darnell Jayne
*Assistant Examiner* — Hiwot Tefera
(74) *Attorney, Agent, or Firm* — Oyen Wiggs Green & Mutala LLP

(57) ABSTRACT

Components for assembling a modular exhibit structure are provided. These components include: frames, connectors (for connecting together frames), panels (for mounting within frames), cover plates (for mounting over sides of frames), and dust covers (for mounting over top of connected frames). These components are configured to allow a single person to assemble an exhibit structure without any specialized tools or mechanical skills.

34 Claims, 9 Drawing Sheets

(56) References Cited

U.S. PATENT DOCUMENTS

| | | | | |
|---|---|---|---|---|
| 4,685,255 | A | 8/1987 | Kelley | |
| 4,747,644 | A * | 5/1988 | Gallery et al. | 312/140 |
| 4,774,792 | A * | 10/1988 | Ballance | 52/285.2 |
| 4,822,199 | A | 4/1989 | Nehls | |
| 4,928,465 | A * | 5/1990 | Del Castillo Von Haucke | 52/239 |
| 4,941,717 | A * | 7/1990 | Beaulieu | 312/265.3 |
| 5,039,177 | A * | 8/1991 | Newell et al. | 312/111 |
| 5,069,263 | A * | 12/1991 | Edwards | 160/135 |
| 5,134,826 | A * | 8/1992 | La Roche et al. | 52/584.1 |
| 5,327,699 | A | 7/1994 | Khan | |
| 5,382,087 | A * | 1/1995 | Pouch | 312/140.2 |
| 5,477,594 | A * | 12/1995 | LePage | 27/1 |
| 5,524,977 | A | 6/1996 | Orawski | |
| 5,544,438 | A * | 8/1996 | Fazekas | 40/605 |
| 5,626,926 | A * | 5/1997 | Roberts | 428/14 |
| 5,642,593 | A * | 7/1997 | Shieh | 52/239 |
| 5,737,887 | A * | 4/1998 | Smeenge | 52/282.2 |
| 5,803,146 | A | 9/1998 | Boon | |
| 5,881,518 | A * | 3/1999 | Edwards et al. | 52/239 |
| 5,887,373 | A * | 3/1999 | Byers | 40/733 |
| 5,921,190 | A | 7/1999 | Wood | |
| 6,086,174 | A * | 7/2000 | Graves et al. | 312/263 |
| 6,095,226 | A * | 8/2000 | Chen et al. | 160/135 |
| 6,105,322 | A * | 8/2000 | Chang | 52/238.1 |
| 6,216,397 | B1 * | 4/2001 | Chang | 52/36.1 |
| 6,267,525 | B1 * | 7/2001 | Wu | 403/49 |
| 6,295,764 | B1 * | 10/2001 | Berridge et al. | 52/36.5 |
| 6,318,692 | B1 * | 11/2001 | Cyrell | 248/317 |
| 6,351,916 | B2 | 3/2002 | Militzer | |
| 6,397,533 | B1 * | 6/2002 | Hornberger et al. | 52/239 |
| 6,398,322 | B1 | 6/2002 | Chaplin | |
| 6,494,247 | B1 | 12/2002 | Pedone | |
| 6,546,675 | B1 * | 4/2003 | Adderton | 52/71 |
| 6,557,955 | B2 | 5/2003 | Saravis | |
| 6,766,989 | B2 * | 7/2004 | Liu | 248/125.2 |
| 6,808,074 | B1 * | 10/2004 | Schwartz | 206/577 |
| 7,059,093 | B2 * | 6/2006 | Akers | 52/506.06 |
| 7,150,127 | B2 * | 12/2006 | Underwood et al. | 52/36.1 |
| 7,237,749 | B2 | 7/2007 | Ritts | |
| 7,757,510 | B2 * | 7/2010 | Rosete et al. | 62/298 |
| 7,845,135 | B2 * | 12/2010 | Sibbett | 52/656.9 |
| 2002/0043349 | A1 * | 4/2002 | Rigby et al. | 160/135 |
| 2003/0085640 | A1 * | 5/2003 | Chan | 312/262 |
| 2003/0201698 | A1 * | 10/2003 | Liang et al. | 312/262 |
| 2004/0050504 | A1 * | 3/2004 | Chen | 160/135 |
| 2004/0075371 | A1 * | 4/2004 | Latchinian | 312/140 |
| 2005/0204664 | A1 * | 9/2005 | Snyder | 52/302.1 |
| 2007/0039270 | A1 * | 2/2007 | Hollman | 52/456 |
| 2008/0229689 | A1 | 9/2008 | Trionfetti | |

FOREIGN PATENT DOCUMENTS

| | | | |
|---|---|---|---|
| CA | 2167246 | C | 3/2007 |
| CA | 2605031 | A1 | 4/2008 |
| GB | 2417883 | A | 3/2006 |
| WO | 2005093180 | A2 | 10/2005 |
| WO | 2006096997 | A1 | 9/2006 |

OTHER PUBLICATIONS

TESS Demountable Showcases. Modular Demountable Showcase System. Click Netherfield International Museum Showcase Manufacturers. [Brochures].

* cited by examiner

MODULAR EXHIBIT STRUCTURE

TECHNICAL FIELD

This invention relates generally to the field of modular structures or partitions. More particularly, this invention relates to the field of modular exhibit structures such as display cases or showcases for use in galleries, museums or the like.

BACKGROUND

Modular structures of various types, including modular structures specifically adapted for exhibitions, are known in the prior art. For example, U.S. Pat. No. 4,186,533 to Jensen discloses a modular exhibit structure comprising panels and panel connectors. One drawback of such prior art is that the panels may be heavy and cumbersome, necessitating more than one person be involved in the assembly and disassembly of an exhibit structure.

There is a need for apparatus and methods that provide modular exhibit structures that are versatile, cost effective and capable of being assembled together quickly and easily by a single person.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One embodiment of the present invention relates to a modular exhibit structure comprising: a plurality of upright frames, each frame comprising an upper rail, a lower rail, and two side members extending perpendicularly between the upper rail and the lower rail, wherein an inner face of each side member has an indentation in a direction away from the other side member of the frame; one or more connectors connecting together one of the side members of each of the frames with one of the side members of an adjacent frame; a rectangular panel removably mounted within each frame, the panel configured to fit between the two side members of the frame; and one or more cover plates removably mounted over the adjacent side members of connected frames.

The indentations in the side members of each frame are preferably configured to provide a gap between the side members of the frame and sides of the mounted panel sufficient to allow a person to grip the sides of the panel.

Modular exhibit structures according to this invention may further comprise a dust cover removably mounted over top of the connected frames and/or one or more shelves within the exhibit structure, each shelf attached to an inside face of one or more of the panels.

In some embodiments of this modular exhibit structure each side member comprises one or more hooks extending outward from the side member, and each connector comprises two or more connecting faces each having a slot configured to engage one of the hooks. The connecting faces of one or more of the connectors may comprise outer and inner walls having aligned outer and inner slots respectively, the outer slot configured to engage a base portion of one of the hooks and the inner slot configured to engage an outwardly-extending portion of the hook.

In some embodiments of this modular exhibit structure each of the cover plates has an inward face comprising one or more tabs, and the adjacent side members of connected frames comprise one or more corresponding tabs, such that each of the cover plates may be removably mounted over the adjacent side members of connected frames by engaging the tabs of the cover plate with the corresponding tabs of the side members.

Another embodiment of the present invention relates to a frame component of a modular exhibit structure, the frame component configured to receive a correspondingly-sized rectangular panel, the frame component comprising: an upper rail; a lower rail; and two side members extending perpendicularly between the upper rail and the lower rail, wherein an inner face of each side member has an indentation in a direction away from the other side member of the frame component.

Another embodiment of the present invention relates to a modular exhibit structure kit comprising: a plurality of frames, each frame comprising an upper rail, a lower rail, and two side members extending perpendicularly between the upper rail and the lower rail, wherein an inner face of each side member has an indentation in a direction away from the other side member of the frame; a plurality of connectors configured to connect together one of the side members of each of the frames with one of the side members of an adjacent frame; a plurality of panels, each panel configured to fit between the two side members of one of the frames; and a plurality of cover plates configured to be removably mounted over the adjacent side members of the frames when connected.

Another embodiment of the present invention relates to a method for assembling a modular exhibit structure, the method comprising: connecting together a plurality of upright frames, each frame comprising an upper rail, a lower rail, and two side members extending perpendicularly between the upper rail and the lower rail and wherein an inner face of each side member has an indentation in a direction away from the other side member of the frame, by connecting together one of the side members of each of the frames to one of the side members of an adjacent frame; mounting a panel within each frame, the panel configured to fit between the side members of the frame; and mounting cover plates over the adjacent side members of the connected frames. This method may further comprise mounting a dust cover over top of the connected frames.

The step of mounting the panel within each frame may comprise lifting the panel such that a groove along a top face of the panel engages the upper rail of the frame and then lowering the panel such that a groove along a bottom face of the panel engages the lower rail of the frame.

The mounting of the cover plates over the adjacent side members of the connected frames is preferably done such that outward faces of the cover plates extend between adjacent edges of adjacent panels mounted within the connected frames and such that the panels are visible but the connectors between connected frames and the adjacent side members are concealed.

In some embodiments of this method each side member comprises one or more hooks extending outward from the side member, and the step of connecting together the upright frames comprises sliding one or more connectors between adjacent side members of adjacent frames such that slots in the connectors engage the one or more hooks.

In some embodiments of this method each of the cover plates has an inward face comprising one or more tabs, and the side members of the connected frames comprise one or more corresponding tabs, and the step of mounting the cover plates over the adjacent side members of the connected frames comprises sliding the cover plates over the adjacent side members such that the tabs of the cover plates engage the corresponding tabs of the side members.

In addition to the exemplary aspects and embodiments described above, further aspects and embodiments will become apparent by reference to the drawings and by study of the following detailed descriptions.

BRIEF DESCRIPTION OF DRAWINGS

Exemplary embodiments are illustrated in referenced figures of the drawings. It is intended that the embodiments and figures disclosed herein are to be considered illustrative rather than restrictive.

DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Aspects of this invention provide modular components for assembling exhibit structures of varying shapes and sizes. As described in more detail herein, these components include: upright frames, connectors (for connecting together frames), panels (for mounting within frames), cover plates (for mounting over sides of frames), and dust covers (for mounting over top of connected frames). Other aspects of this invention provide exhibit structures assembled from these various components. Other aspects of this invention provide methods for assembling exhibit structures from these various components.

Figure 1:
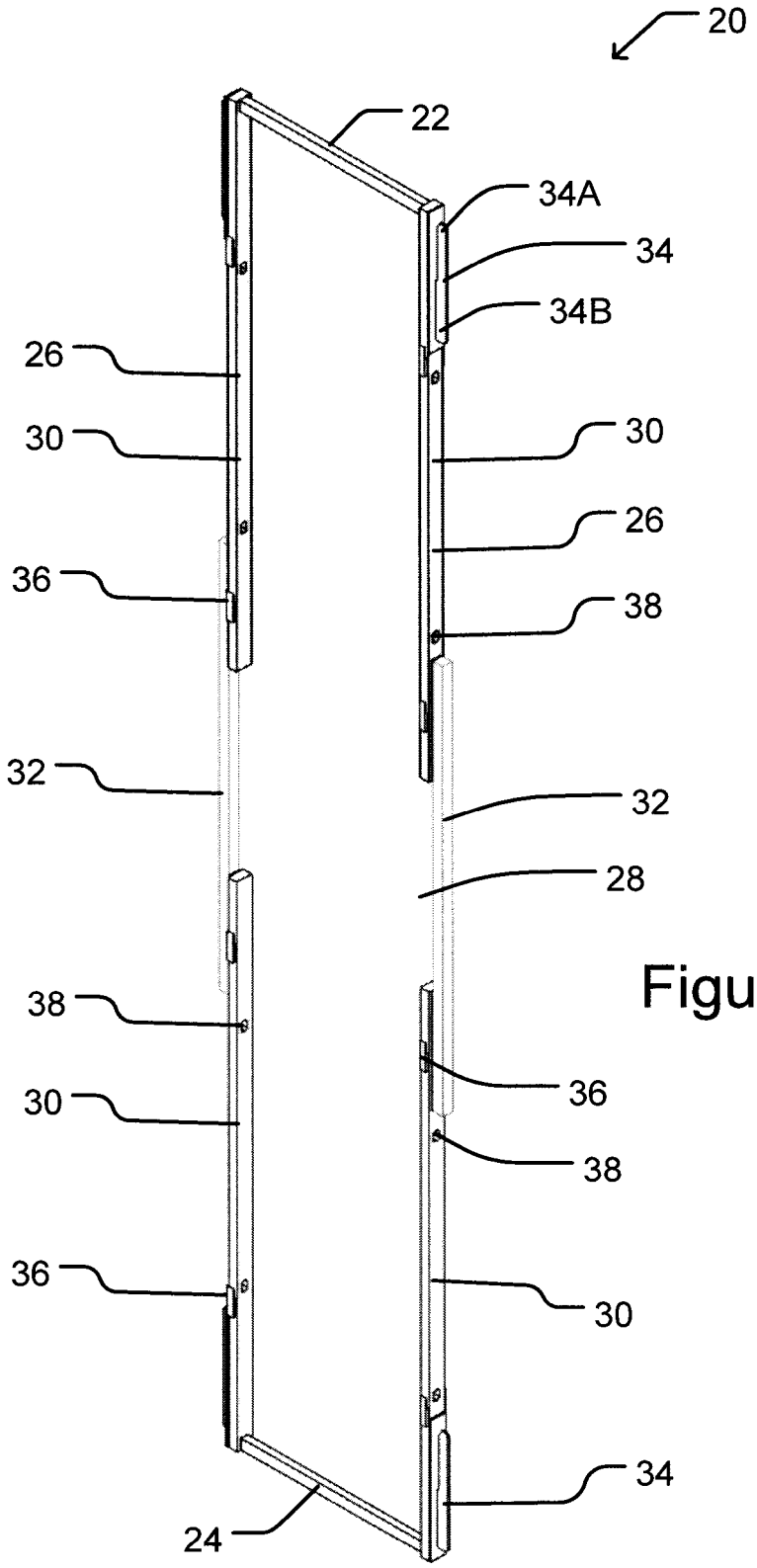
FIG. 1 is an isometric view of a frame component of an exhibit structure according to an example embodiment of the present invention.

FIG. 1 shows a frame component 20 of an exhibit structure according to an example embodiment of the invention. Frames 20 may be pre-fabricated in a plurality of generally rectangular standardized sizes. By way of non-limiting example, in some embodiments frames 20 are provided having widths of 18", 36" and 72" and a common height of 90".

Frame 20 as illustrated comprises an upper rail 22, a lower rail 24 and two side members 26. In preferred embodiments, side members 26 are configured to provide an indentation 28 in the vicinity of their mid-section to facilitate insertion of panels into the frames (as described further below). In the illustrated embodiment, each side member 26 comprises a central outer section 32 connected between upper and lower inner sections 30. Outer section 32 spans indentation 28 which is formed in the space between upper and lower inner sections 30.

Frame 20 may comprise hooks 34 protruding outward from side members 26 to engage connectors (as described further below). In the illustrated embodiment two upward-pointing hooks 34 protrude outward from each side of frame 20 (near the top and bottom of side members 26).

Frame 20 may also comprise tabs 36 on the front and back faces of side members 26 to engage cover plates (as described further below). In the illustrated embodiment four upward-pointing tabs 36 are positioned along each of the front and back faces of each side member 26.

As illustrated in FIG. 1, one or more holes 38 may be provided through side members 26 to allow frame 20 to be more securely fastened to an inserted panel as described further below.

Figure 2A:
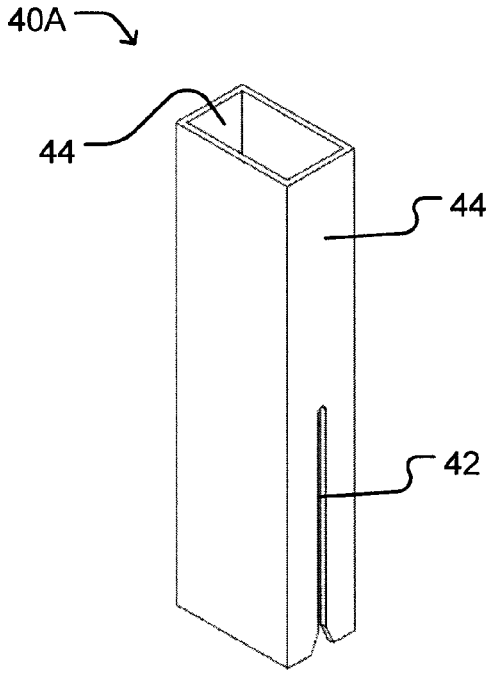
FIGS. 2A-2D are isometric views of various frame connectors of an exhibit structure according to example embodiments of the present invention.
Figure 2B:
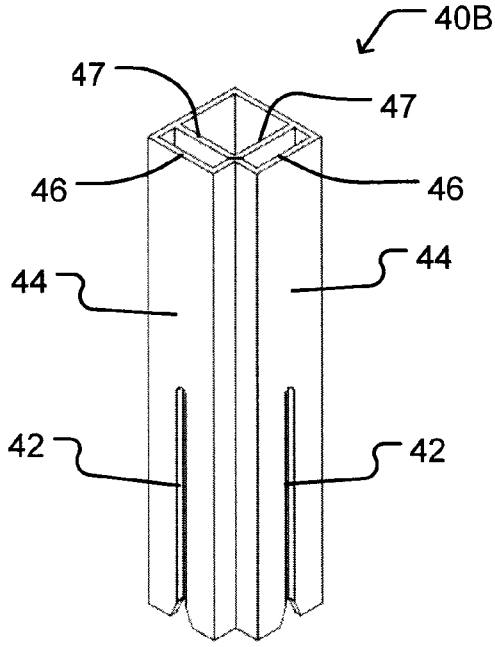
Figure 2C:
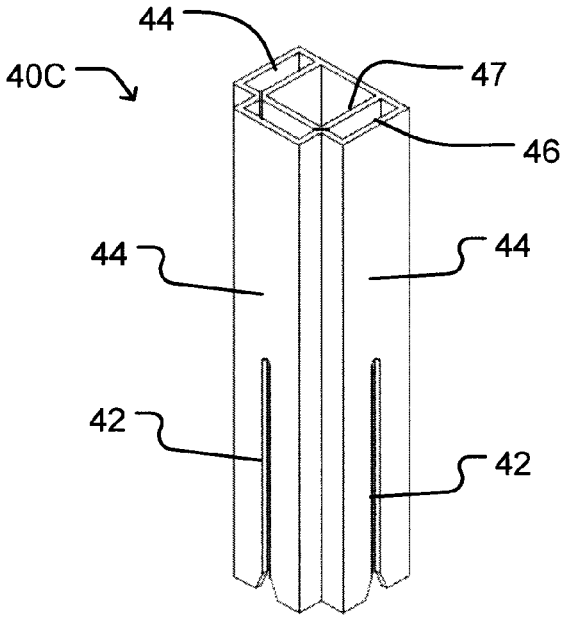
Figure 3A:
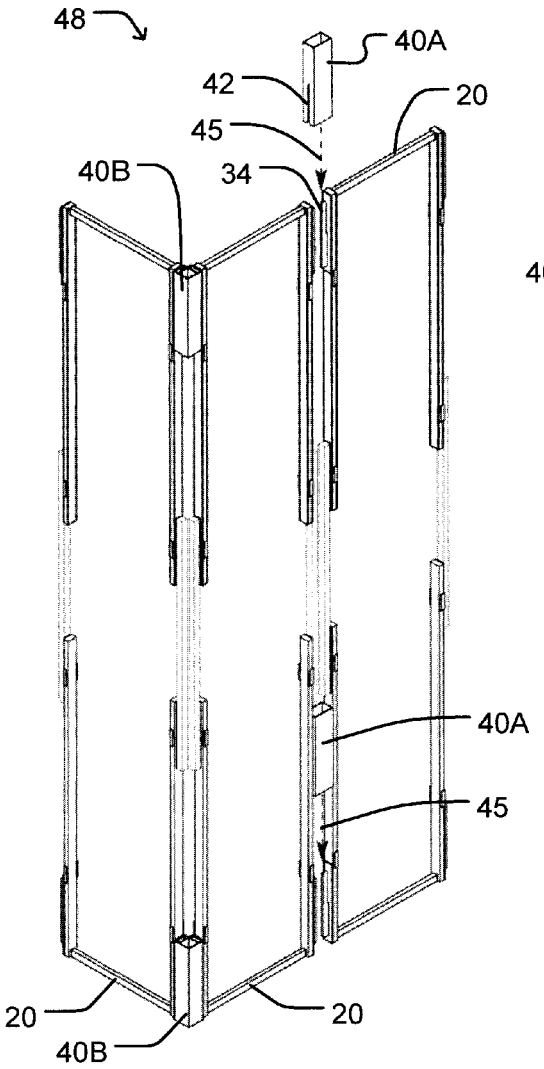
FIGS. 3A-3B are isometric view of frames connected together using connectors according to example embodiments of the present invention.
Figure 3B:
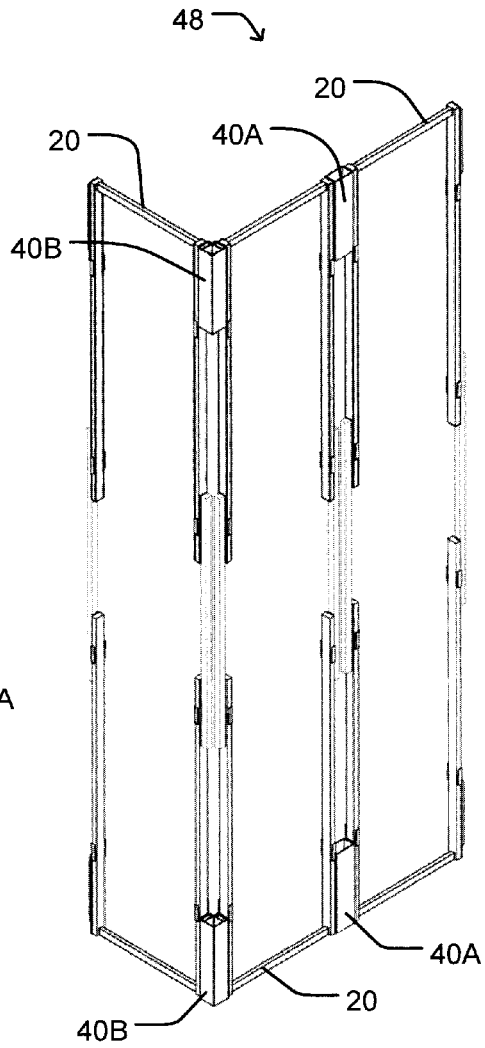

FIGS. 2A-2C illustrate three types of frame connectors, 40A, 40B and 40C respectively (collectively connectors 40), according to example embodiments of this invention. Connector 40A is configured to connect two frames 20 together at a 180 degree angle (as shown in FIGS. 3A, 3B); connector 40B is configured to connect two frames 20 together at a 90 degree angle (as shown in FIGS. 3A, 3B); and connector 40C is configured to connect three frames 20 together in a T-configuration.

Connectors 40A, 40B and 40C are non-limiting examples of types of connectors 40. As can be appreciated, connectors 40 may be adapted to connect together frames 20 at various other angles and in various other configurations. In some embodiments, standardized connectors such as connectors 40A, 40B and 40C are pre-fabricated from aluminum using an extrusion process.

Connectors 40 comprise two or more connecting faces 44 each having a slot 42 for receiving a hook 34 of a frame 20. In the illustrated embodiments, slots 42 are downward facing so as to engage upward-facing hooks 34 of frames 20 when a connector 40 is slid downward between the sides of adjacent frames (as shown in FIGS. 3A, 3B). Connector 40A comprises slots 42 on two opposing parallel faces 44. Connector 40B comprises slots 42 on two adjacent perpendicular faces 44. Connector 40C comprises slots 42 on three adjacent faces 44. The opening of slots 42 and the tips of hooks 34 may be beveled so as facilitate the guiding of hooks 34 into slots 42 when connector 40 is slid into place.

Figure 2D:
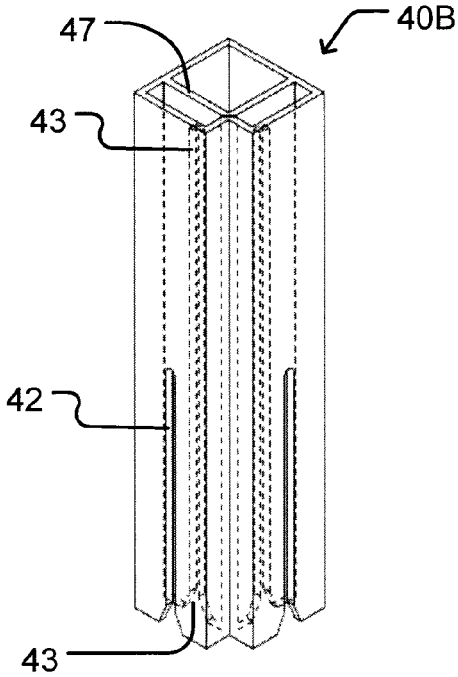

As shown in FIGS. 2B and 2C, connecting faces 44 may comprise an outer wall 46 and an inner wall 47. FIG. 2D is similar to FIG. 2B except that portions of inner wall 47 hidden behind outer wall 46 are outlined in dotted lines. In these embodiments, outer wall 46 is configured to slide inside the extending portion 34A of hook 34 while inner wall 47 is configured to intercept extending portion 34A of hook 34. As shown in FIG. 2D, inner wall 47 comprises an inner slot 43 that is aligned with slot 42 in outer wall 46 but is longer by about the length of extending portion 34A of hook 34. Inner slot 43 in inner wall 47 is thus configured to engage the entire length of hook 34 when slot 42 in outer wall 46 engages the base portion 34B of hook 34.

This double-walled design has the advantage that when connector 40 is engaged with hook 34, inner wall 47 holds hook 34 laterally in place and prevents hook 34 from twisting or otherwise moving laterally within connector 40. Double-walled connectors may thereby provide sturdier connections between frames 20 than equivalent single-walled connectors. In particular, frames 20 connected at 90° angles may be more stable when connected using double-walled connectors (such as connectors 40B and 40C illustrated in FIGS. 2B and 2C). However, this double-walled design is not limited to connectors 40B and 40C. It may be applied generally to connectors configured to connect frames at 180° or any other angle.

Another benefit to the double-walled design of connectors 40B and 40C illustrated in FIGS. 2B and 2C is that they may be easier to fabricate by extrusion than equivalent single-walled connectors having the same cross-sectional dimensions. In some embodiments, a family of connectors are fabricated having common inner wall dimensions. In some embodiments, a base connector is extruded having all faces double-walled and a family of connectors are fabricated from the base connector by shearing off one or more protruding outer walls. For example, connectors such as connectors 40B and 40C may be fabricated by extruding a base connector having four perpendicular double-walled faces and then shearing off one or two of the outer walls from the base connector.

FIGS. 3A and 3B illustrate a frame configuration 48 comprising three frames 20 connected together by connectors 40 according to an example embodiment of this invention. Connectors 40A are shown connecting frames 20 together at a 180 degree angle, and connectors 40B are shown connecting frames 20 together at a 90 degree angle.

FIG. 3A illustrates connectors 40A positioned above hooks 34 of frames 20 prior to being slotted in place between frames 20. Connectors 40 are installed by sliding them downward in the direction indicated by arrows 45 such that slots 42 engage hooks 34. FIG. 3B illustrates connectors 40A fully installed on frame configuration 48.

Figure 4:
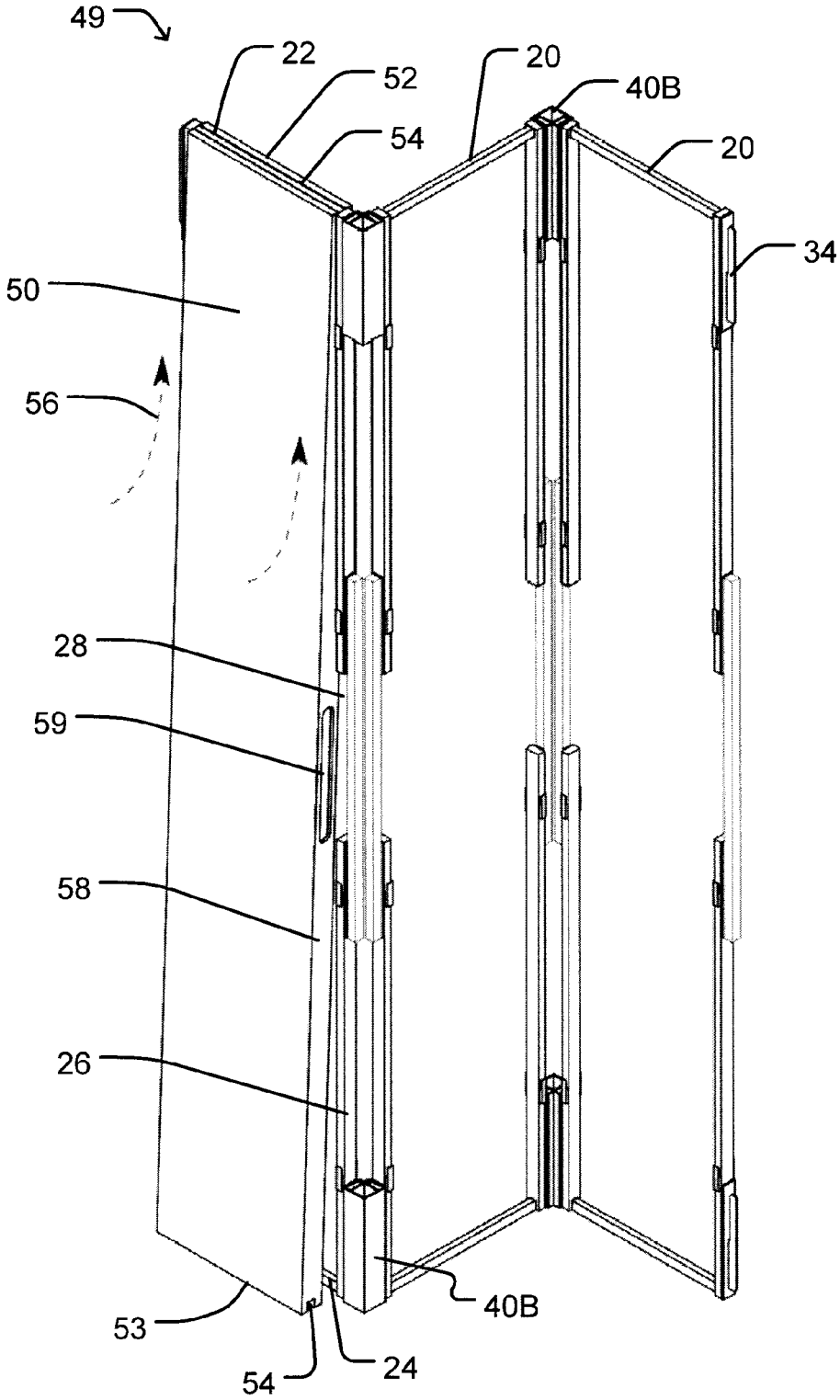
FIG. 4 is an isometric view of a panel partially inserted into a frame of an exhibit structure according to an example embodiment of the present invention.
Figure 5A:
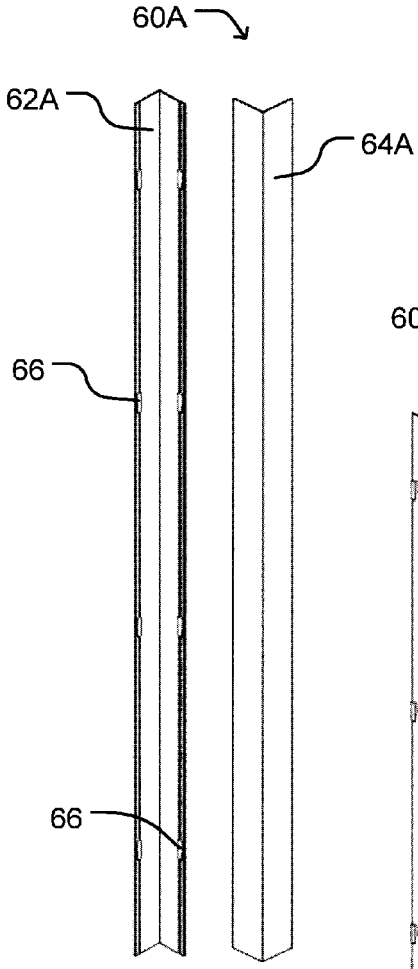
FIGS. 5A-5D are isometric views of front and rear sides of various cover plates of exhibit structures according to example embodiments of the present invention.
Figure 5B:
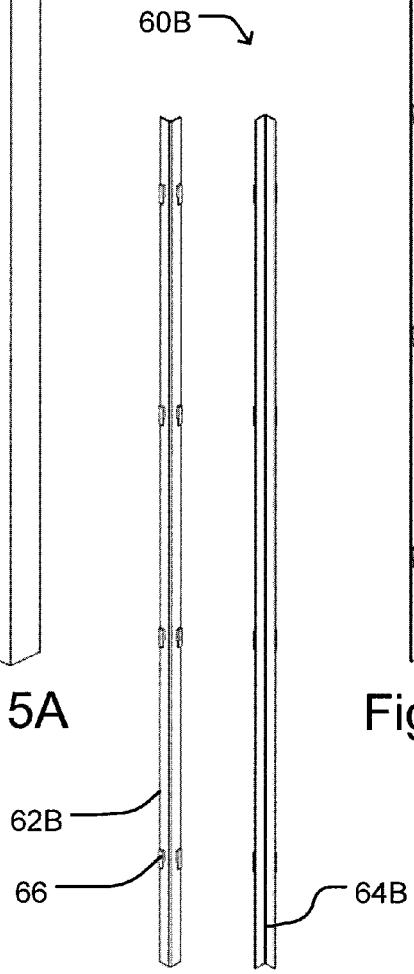
Figure 5C:
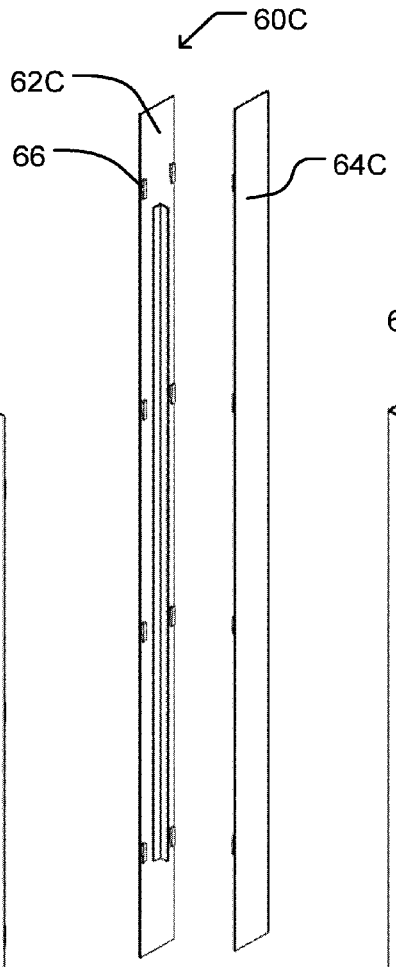
Figure 5D:
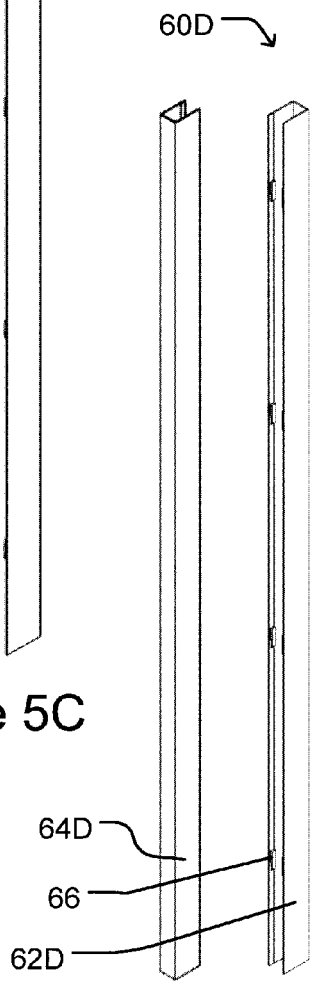
Figure 7:
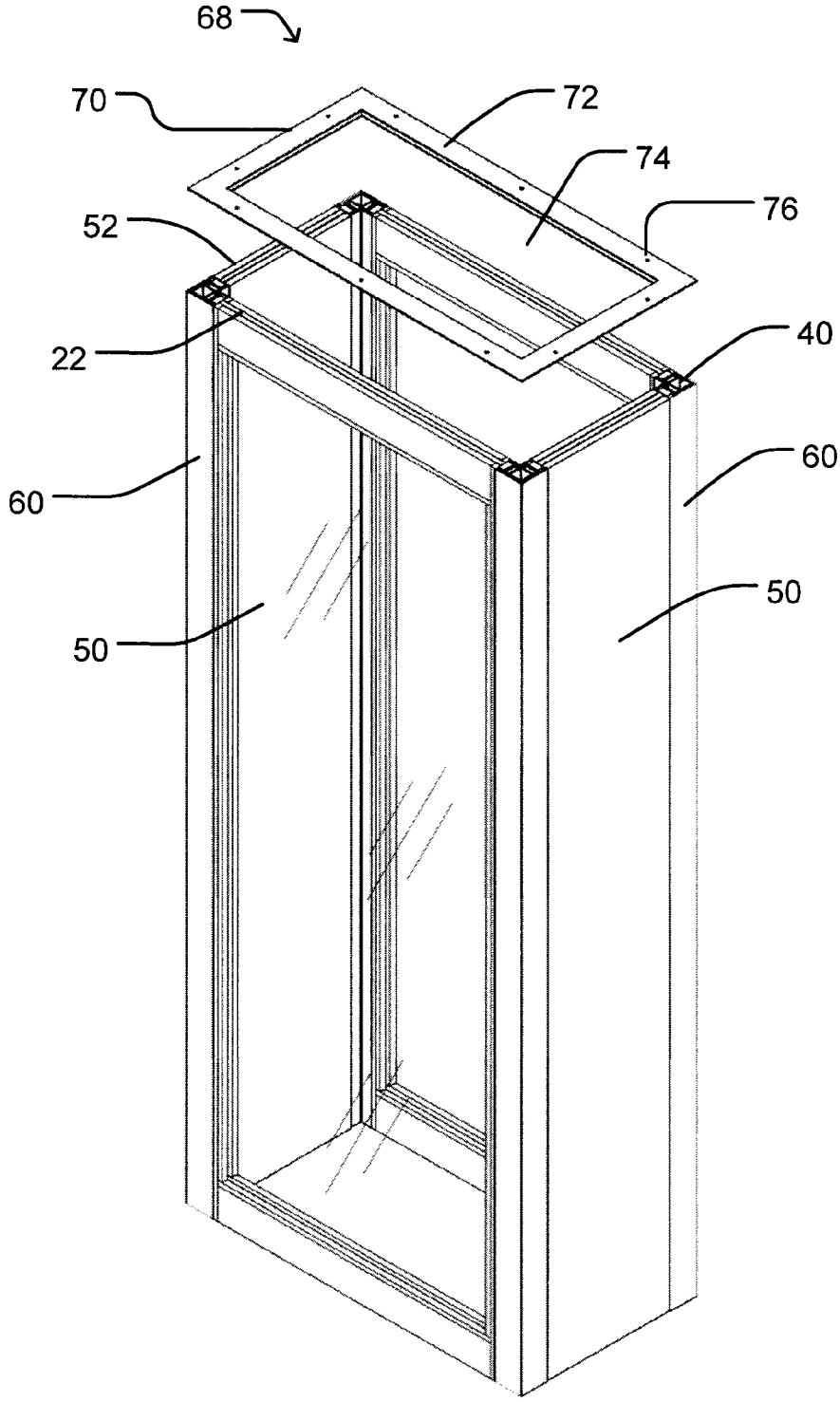
FIG. 7 is a partially exploded isometric view of an exhibit structure with a dust cover according to an example embodiment of the present invention.

FIG. 4 illustrates an example frame configuration 49 comprising three connected frames 20 according to an embodiment of the present invention. In the illustrated embodiment, a panel 50 is partially inserted into a frame 20. Panels 50 are configured to fit within frames 20 to form the walls of an exhibit structure. Panels 50 may be prefabricated in standardized rectangular sizes which correspond to the sizes of provided frames 20 (for example, having a height of 90" and widths of 18", 36" and 72"). Panels 50 may be configured to provide a variety of appearances. For example, panels 50 may be constructed from wood to provide a uniform opaque front and back surface (as shown in FIG. 4), or may incorporate a pane of glass to provide a standardized transparent surface (as shown in FIG. 7), or may be customized to produce any desired appearance.

In the embodiment illustrated in FIG. 4, top and bottom faces 52, 53 of panels 50 have grooves 54 extending along their length configured to engage upper and lower rails 22, 24 of frame 20 respectively. Panel 50 may be mounted onto frame 20 by lifting panel 50 in the direction of arrows 56 such that groove 54 along top face 52 engages upper rail 22 (as shown) and then lowering panel 50 such that groove 54 along bottom face 53 engages lower rail 24. The sides 58 of panel 50 may be provided with recessed hand-holds 59 to facilitate lifting and inserting panel 50 into frames 20.

As mentioned above in relation to FIG. 1, side members 26 of frames 20 preferably provide indentations 28. Indentations 28 facilitate the installation of panels 50 into frames 20 by providing space for a person's hands to maneuver panel 50 within frame 20 when gripping panel 50 by hand-holds 59 or at a corresponding position along sides 58. This feature assists in allowing a single person to safely lift and insert panel 50 within frame 20, or conversely, to lift and remove panel 50 mounted in frame 20.

In the illustrated embodiment, sides 58 of panel 50 are configured to abut (or nearly abut) inner sections 30 of side members 26 such that panel 50 is laterally held in place by frame 20 once installed. The gap between sides 58 of panel 50 and outer sections 32 of side members 26 provides indentation 28 for a person's hands as described above.

Panel 50 may also comprise holes (not shown) along sides 58, configured to align with holes 38 in frame 20 when panel 50 is mounted within frame 20. In some embodiments, holes provided in frames 20 and panels 50 are configured to receive standardized hand screws (or similar hand operated fasteners) which do not require the use of any tools. Frames 20 and panels 50 may thereby be additionally secured together in order to tighten their fit, straighten their alignment, and enhance the overall structural integrity and security of the exhibit structure.

FIGS. 5A-5D illustrate four types of cover plates, 60A, 60B, 60C and 60D respectively (collectively cover plates 60), according to example embodiments of this invention. Each cover plate 60 is shown from two perspectives: one showing the inward faces of the cover plate (62A, 62B, 62C and 62D respectively, 62 collectively) and one showing outward faces of the cover plate (64A, 64B, 64C and 64D respectively, 64 collectively). Cover plates 60 operate to cover exposed side members 26 and connectors 40 after panels 50 are mounted within frames 20. Inward faces 62 of cover plates 60 are configured to attach to side members 26 of frames 20 and outward faces 64 are configured to provide a finished surface between adjacent edges of adjacent panels 50 in a completed exhibit structure.

Figure 6A:
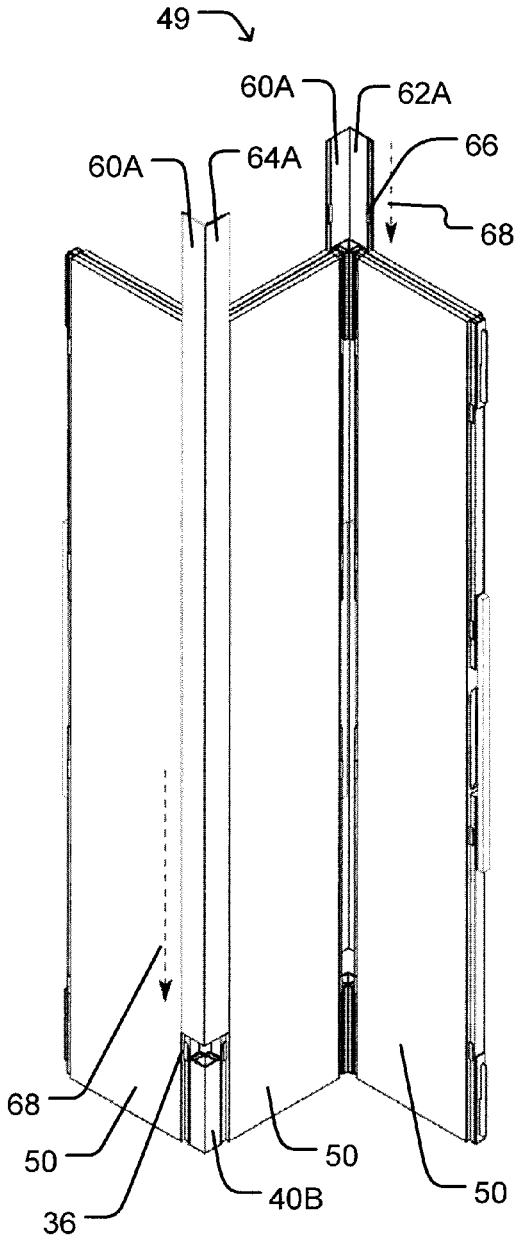
FIGS. 6A-6B are isometric views of cover plates mounted on exhibit structures according to example embodiments of the present invention.
Figure 6B:
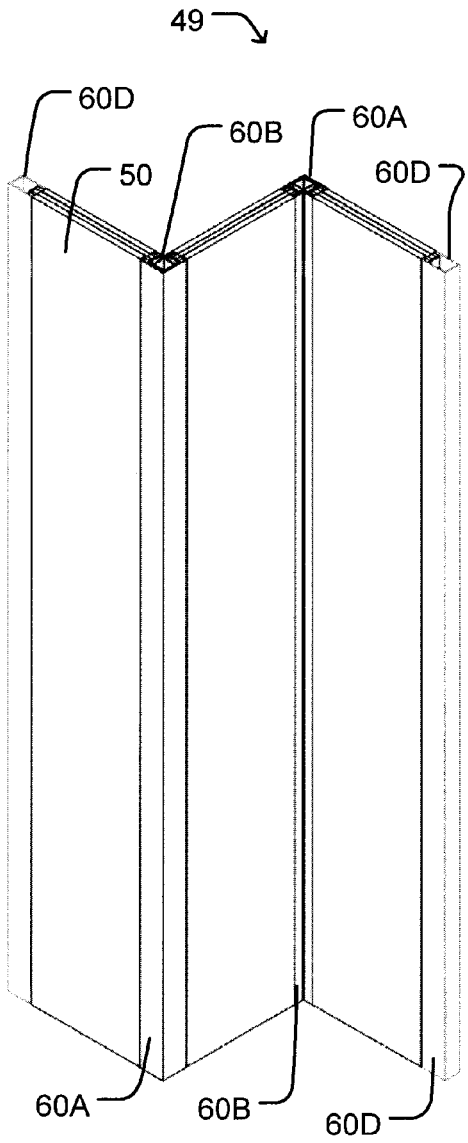

Cover plate 60A is configured to cover the outer corner of the intersection between two frames 20 connected together at a 90 degree angle (as shown in FIGS. 6A and 6B). Cover plate 60B is configured to cover the inner corner of the intersection between two frames 20 connected together at a 90 degree angle (as shown in FIG. 6B). Cover plate 60C is configured to cover the intersection between two frames 20 connected together at a 180 degree angle. Cover plate 60D is configured to cover an exposed side member 26 of a frame 20 to which no other frame is connected (as shown in FIG. 6B).

Each cover plate 60 comprises tabs 66 on inward faces 62 for engaging tabs 36 on side members 26 of frames 20. In the illustrated embodiments, tabs 66 are downward facing so as to engage upward-facing tabs 36 of frames 20 when cover plate 60 is slid downward over side members 26 of frames 20. Each cover plate 60A, 60B, 60C and 60D as illustrated comprises eight tabs 66 in total, four along the length of each side of inward faces 62A, 62B, 62C and 62D respectively.

Cover plates 60A, 60B, 60C and 60D are non-limiting examples of possible cover plates 60. As will be appreciated, cover plates 60 may be adapted to various different configurations of frames as necessary.

FIG. 6A illustrates frame configuration 49 (as shown in FIG. 4) with cover plates 60A in position for being mounted over the outer corners of the intersections between frames 20.

Cover plates 60A are mounted by sliding them downward in the direction indicated by arrows 68 such that tabs 66 on cover plates 60A engage with tabs 36 on side members 26 of frames 20.

FIG. 6B shows frame configuration 49 with cover plates 60 attached over all exposed frame side members 26. Cover plates 60A cover the outer corners of the frame intersections, cover plates 60B cover the inner corners of the frame intersections and cover plates 60D cover the two exposed sides to which no other frame is connected.

FIG. 7 illustrates a dust cover 70 positioned over top of an exhibit structure 68 according to an example embodiment of the present invention. Dust covers 70 operate to enclose the top of exhibit structures and thereby protect the contents of exhibit structures. Dust covers 70 are configured to fit over top of exhibit structures formed by various arrangement of the components described above. In particular, dust covers 70 may be prefabricated in standardized rectangular sizes (e.g. 18"×36", 36"×36", 36"×72", etc.) corresponding to the standardized sizes of frames 20.

Dust covers 70 comprise a frame 72 enclosing a ceiling panel 74. In the illustrated embodiment, panel 74 is made of a transparent material such as glass to allow light into the exhibit structure, but it may be made of any suitable material. As illustrated, frame 72 may have a plurality of screw holes 76 around its perimeter for facilitating the attachment of dust cover 70 to exhibit structure 68. Screw holes 76 may align with corresponding screw holes (not shown) along the top face of frames 20 such that dust cover 70 may be fastened to the underlying exhibit structure by screws (not shown) or other suitable fastening means.

The fastening of dust cover 70 over top of an exhibit structure (by way of screw holes 76 or otherwise) may serve to provide added structural support and security to the assembled exhibit structure. For example, while attached dust cover 70 may serve to block upward motion of underlying panels 50, cover plates 60 and connectors 40 and thereby prevent disassembly of the exhibit structure (until dust cover 70 is removed). Also, dust cover 70 may serve to straighten and reinforce the alignment of frames 20 (such as in a rectangular alignment) within an exhibit structure.

Figure 8:
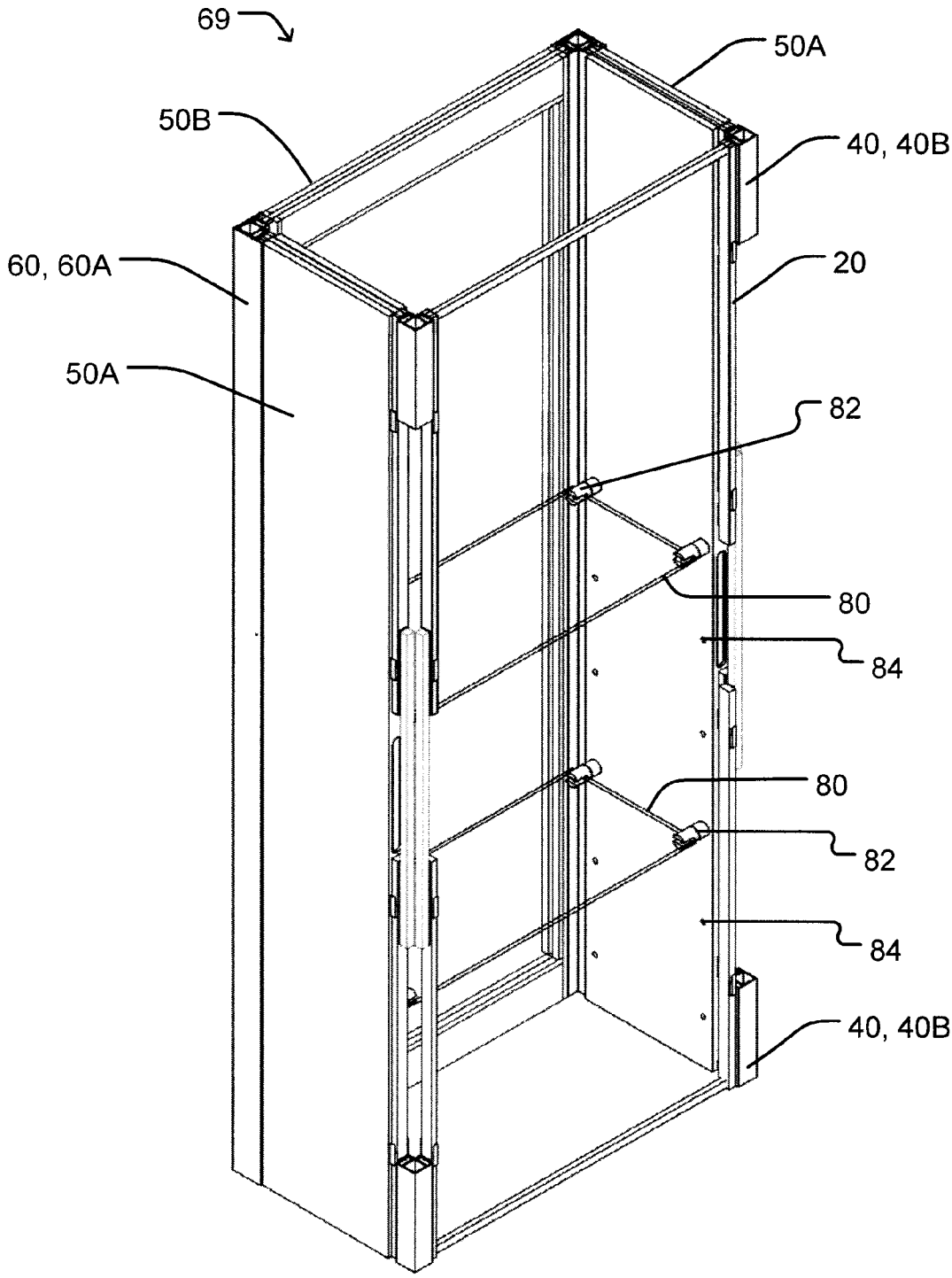
FIG. 8 is an isometric view of a partially assembled exhibit structure with shelving components according to an example embodiment of the present invention.

FIG. 8 illustrates a partially assembled exhibit structure 69 with shelves 80 installed according to an example embodiment of the invention. In the illustrated embodiment, four frames 20 are connected together in a rectangular configuration using connectors 40B. Three of the four frames have panels 50 inserted within them. Two opaque panels 50A form the side walls of exhibit structure 69 and a glass panel 50B forms the rear wall of exhibit structure 69. Cover plates 60 are attached between side panels 50A and rear panel 50B. Shelves 80 are installable into exhibit structure 69 through the remaining open front frame.

In the illustrated embodiment, shelves 80 are held in place by shelf clips 82 attached to side panels 50A. The inside face of side panels 50A may be provided with suitably spaced attachment points 84 for receiving shelf clips 82. Attachment points 84 are configured to hold shelf clips 82 in place and support the weight of shelves 80. Attachment points 84 may be adapted to engage various types and arrangements of shelving systems or display systems.

Shelves 80, or other means of supporting objects to be displayed, may be configured to fit within exhibit structures of various sizes and configurations. Shelves 80 may be made of glass (as illustrated) or any other suitable material. Shelves 80 (or other means of supporting objects to be exhibited) may attach to an exhibit structure in any suitable manner or may be configured to be self-standing within an exhibit structure.

The components described above may be quickly and easily assembled together in a modular fashion to build open or closed structures of varying shapes and sizes. By way of non-limiting example, the components described above may be assembled together to provide a versatile exhibit system for a museum or gallery. In preferred embodiments, frames 20, connectors 40, panels 50 and cover plates 60 are configured to allow a single person of average strength to assemble them together without any tools or particular mechanical skills. Components such as frames 20, connectors 40 and cover plates 60 may be made of aluminum so as to be lightweight. Wood panels may comprise a hollow-core filled with a lightweight substance such as honeycomb corrugated cardboard or the like. Particular components, such as large glass panels or dust covers, may require multiple persons to safely install. Attaching a dust cover 70 over an exhibit structure may involve using a simple tool such a screwdriver in order to engage screws through holes 76 to enhance the safety and security of the structure.

Providing frames 20 independent of panels 50 allows exhibit structures according to embodiments of the present invention to be assembled, altered and disassembled more easily than if frames and panels were pre-fabricated together as a single component. Frames 20 are lighter and more maneuverable than would be frames and panels combined, allowing them to be easily connected together to form the underlying framework of exhibit structure. Panels 50 may subsequently be inserted, removed or interchanged without affecting the underlying frame structure.

Figure 9:
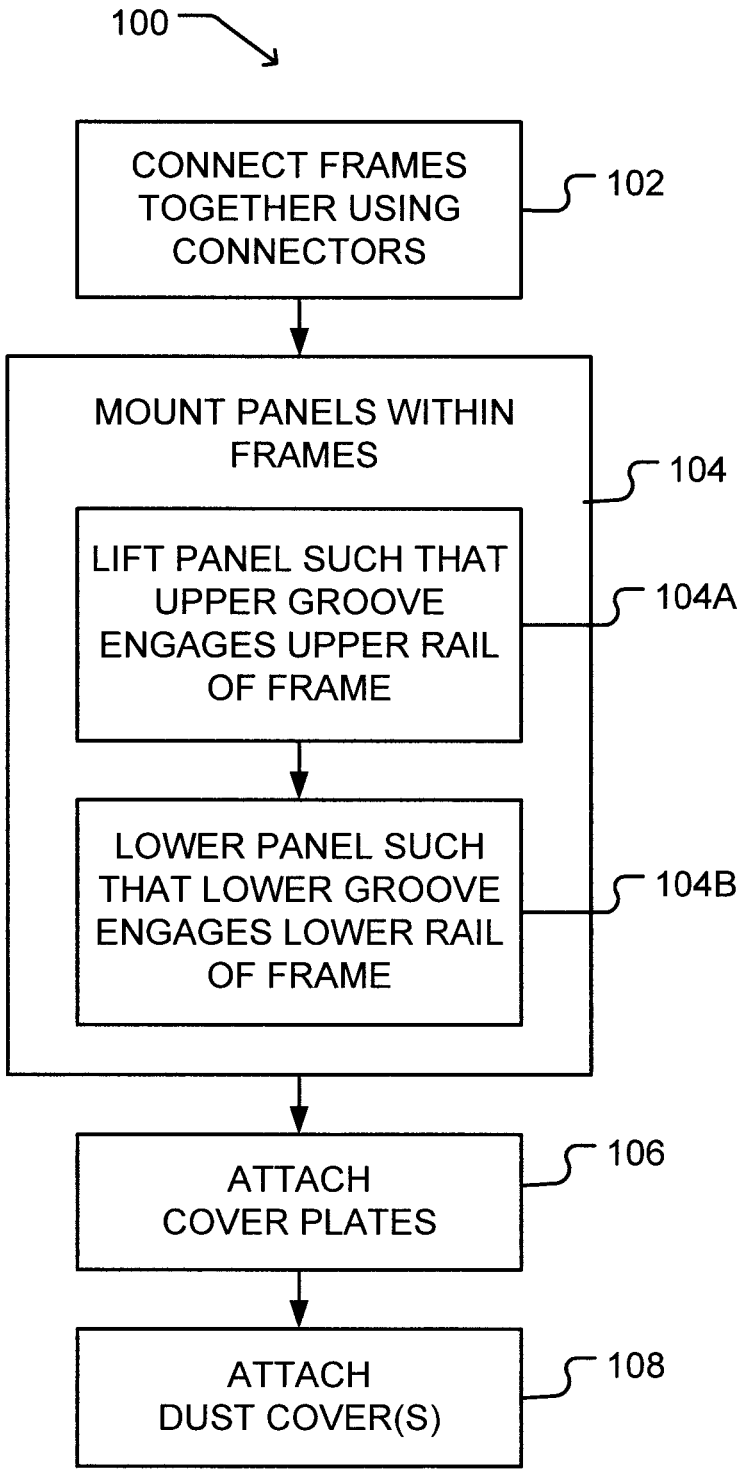
FIG. 9 is a flowchart illustrating steps of a method of assembling an exhibit structure according to a particular embodiment of the invention.

FIG. 9 illustrates a method 100 of assembling an exhibit structure according to an example embodiment of the invention. At block 102 of method 100, frames 20 are interconnected in a desired configuration using connectors 40 so as to form the underlying framework of the exhibit structure. As described above, in some embodiments connectors 40 engage frames 20 by sliding slots 42 downward over upward facing hooks 34 on side members 26 of frames 20.

At block 104 of method 100, panels 50 of appropriate sizes (corresponding to the sizes of frames 20) are mounted within frames 20 to form the walls of the exhibit structure. As described above, panels 50 may be prefabricated of wood, glass or any other material to provide a desired appearance. Block 104 of method 100 comprises sub-blocks 104A and 104B.

At sub-block 104A, panel 50 is lifted such that groove 54 along its top face 52 engages upper rail 22 of frame 20. In some embodiments, recessed handholds 59 are provided in the sides of panel 50 to facilitate gripping and lifting panel 50. As illustrated in FIG. 4, handholds 59 are preferably positioned so as to correspond with the position of indentations 28 of frames 20.

At sub-block 104B, the bottom face 53 of panel 50 is aligned over the lower rail 24 of frame 20 and panel 50 is lowered such that groove 54 along bottom face 53 engages lower rail 24 of frame 20. As described above in relation to FIGS. 1 and 4, in preferred embodiments side members 26 of frame 20 are provided with indentations 28 to allow space for a person's hands when maneuvering panel 50 within frame 20.

Panel 50 may optionally be further secured to frame 20 by some suitable attachment means. In some embodiments, panel 50 may be further secured to frame 20 by means of hand screws or other fasteners configured to fit into holes 38.

After panels 50 are in place, at block 106 cover plates 60 may be mounted over any exposed sides of frames 20 or intersections between frames 20 to provide a flush finished surface between panels 50. As described above, in some embodiments cover plates 60 are configured to mount on frames 20 by sliding cover plates 60 downward over side members 26 such that downward facing tabs 66 engage upward facing tabs 36 of frames 20. Cover plates 60 are preferably installed after panels 50 because, as illustrated in FIGS. 6A and 6B, cover plates 60 cover indentations 28 which are helpful in installing panels 50.

Lastly, at block 108, one or more dust covers 70 are attached over top of the assembled exhibit structure to provide additional structural support and security. In some embodiments, dust cover 70 is attached by screwing frame 72 into the tops of panels 50 or frames 20 via screw holes 76.

Optionally, method 100 may also comprise a step of installing shelves 80 or other internal display features. In some embodiments, this step is performed after connecting all frames 20 and inserting panels 50 to which such shelving may attach.

An assembled exhibit structure may be disassembled by removing components in the reverse order of method 100. Panels 50 may be removed and interchanged, for example, without need for disassembly of the underlying framework.

The components and methods described herein may be employed in the context of providing exhibit structures for a museum or gallery or in a variety of other contexts. By way of non-limiting example, other possible applications of this invention include providing:

- temporary or permanent wall partitions, for example for galleries, shops, or other commercial or office spaces;
- trade show structures or displays;
- retail displays; and
- other types of displays, showcases, exhibit structures, cubicles, wall partitions, etc.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A modular exhibit structure comprising: a plurality of upright open frames, each frame comprising an upper rail, a lower rail, and two side members extending perpendicularly between the upper rail and the lower rail, wherein an inner face of each side member has an indentation in a direction away from the other side member of the frame; one or more elongate connectors connecting together one of the side members of each of the frames with one of the side members of an adjacent frame, wherein the connectors are slidable along a length of each of the adjacent side members of connected frames, and wherein each side member comprises a plurality of elongate hooks spaced apart along the side member and extending outward from the side member in a direction away from the other side member of its frame, and each connector comprises two or more connecting faces each having an elongate slot configured to engage one of the hooks; each frame having a rectangular panel removably mounted therein, the panel configured to fit between the two side members of the frame; and one or more cover plates removably mounted over the adjacent side members of connected frames; wherein the indentations in the side members of each frame are configured to provide a gap between the side members of the frame and sides of the panel mounted therein sufficient to allow a person to grip the sides of the panel; and wherein the sides of each panel is provided with a recessed hand-hold at a location corresponding to the indentations to facilitate lifting and inserting each panel.

2. A modular exhibit structure according to claim 1 wherein each panel comprises a first groove along a first end face, the first groove configured to directly engage the upper rail of the frame in which it is mounted, and a second groove along a second end face, the first and second end faces located at opposite ends of the panel, the second groove configured to directly engage the lower rail of the frame in which it is mounted.

3. A modular exhibit structure according to claim 1 wherein one or more holes are defined through each side member, and the panel mounted within each frame is fastened to the frame by fasteners through one or more of the holes.

4. A modular exhibit structure according to claim 1 wherein the connecting faces of one or more of the connectors comprise outer and inner walls having aligned outer and inner slots respectively, the outer slot configured to engage a base portion of one of the hooks and the inner slot configured to engage an outwardly-extending portion of the hook.

5. A modular exhibit structure according to claim 1 wherein each of the cover plates has an outward face extending between adjacent edges of adjacent panels mounted within connected frames such that the panels are visible but the connectors between connected frames and the adjacent side members are concealed.

6. A modular exhibit structure according to claim 1 wherein each of the cover plates has an inward face comprising one or more tabs, and the adjacent side members of connected frames comprise one or more corresponding tabs, and wherein each of the cover plates is removably mounted over the adjacent side members of connected frames by engaging the tabs of the cover plate with the corresponding tabs of the side members.

7. A modular exhibit structure according to claim 1 comprising a dust cover removably mounted over top of the connected frames.

8. A modular exhibit structure according to claim 7 wherein the dust cover is fastened so as to prevent upward movement of any of the panels, connectors and cover plates relative to the frames.

9. A modular exhibit structure according to claim 7 wherein the dust cover comprises an outer frame surrounding one of the rectangular panels.

10. A modular exhibit structure according to claim 7 wherein one or more holes are defined through the dust cover and the dust cover is fastened to the connected frames by fasteners through one or more of the plurality of holes.

11. A modular exhibit structure according to claim 7 wherein one or more holes are defined through the dust cover and the dust cover is fastened to the panels mounted within the connected frames by fasteners through one or more of the plurality of holes.

12. A modular exhibit structure according to claim 1 comprising one or more shelves within the exhibit structure, each shelf attached to an inside face of one or more of the panels.

13. A modular exhibit structure according to claim 1 wherein each of the two side members comprises a central outer section connected between upper and lower inner sections, and wherein the indentation is formed between the upper and lower inner sections and the indentation is spanned by the central outer section.

14. A frame component of a modular exhibit structure, the frame component configured to receive a correspondingly-sized rectangular panel, the frame component comprising:

an upper rail; a lower rail; and two side members extending perpendicularly between the upper rail and the lower rail, wherein an inner face of each side member has an indentation in a direction away from the other side member of the frame component, wherein the frame component is an open frame component having an opening configured to receive a panel defined between the upper rail, the lower rail and the two side members; wherein each side member comprises at least one elongate hook extending outward from the side member in a direction away from the other side member of the frame component, wherein the at least one hook is adapted to be received in a corresponding elongate slot of an elongate connector for connecting the side member to one of the side members of an adjacent frame wherein the connector is slideable along a length of the side member; wherein the indentations in the side members are configured to provide a gap between the side members of the frame component and the sides of a panel mountable therein sufficient to allow a person to grip the sides of the panel when mounted within the frame component; and wherein the sides of the panel is provided with a recessed hand-hold at a location corresponding to the indentations to facilitate lifting and inserting the panel when the panel is received in the frame.

15. A frame component according to claim 14 wherein one or more holes are defined through each of the side members, each hole configured to receive a fastener for fastening the frame component to a panel mounted between the side members.

16. A frame component according to claim 14 wherein each side member comprises a plurality of connecting tabs along front and back faces of the side member.

17. A frame component according to claim 14 wherein each of the two side members comprises a central outer section connected between upper and lower inner sections, and wherein the indentation is formed between the upper and lower inner sections and the indentation is spanned by the central outer section.

18. A method for assembling a modular exhibit structure, the method comprising: connecting together a plurality of upright open frames, each frame comprising an upper rail, a lower rail, and two side members extending perpendicularly between the upper rail and the lower rail and wherein an inner face of each side member has an indentation in a direction away from the other side member of the frame, by connecting together one of the side members of each of the frames to one of the side members of an adjacent frame using an elongate connector, wherein the connector has an elongate slot for receiving a corresponding elongate hook of the side member and the connector is slidable along a length of each of the adjacent side members of connected frames; mounting a panel within each frame, the panel configured to fit between the side members of the frame; and mounting cover plates over the adjacent side members of the connected frames; wherein mounting the panel within each frame comprises lifting the panel by using recessed hand-holds on the sides of each panel positioned at a location corresponding to the indentations such that a first groove along a first end face of the panel directly engages the upper rail of the frame and then lowering the panel such that a second groove along a second end face of the panel directly engages the lower rail of the frame.

19. A method according to claim 18 wherein mounting the panel within each frame comprises gripping sides of the panel at a height corresponding to the indentations in the side members of the frame.

20. A method according to claim 18 comprising fastening the panel to the frame.

21. A method according to claim 20, wherein one or more holes are defined through each of the side members of each frame, and wherein fastening the panel to the frame comprises inserting hand operated fasteners through one or more of the holes to fasten the panel within the frame.

22. A method according to claim 18 wherein each side member comprises a plurality of hooks spaced apart along the side member and extending outward from the side member in a direction away from the other side member of its frame, and wherein connecting together the upright frames comprises sliding one or more connectors between adjacent side members of adjacent frames such that slots in the connectors engage the plurality of hooks.

23. A method according to claim 22 wherein mounting the cover plates over the adjacent side members of the connected frames is done such that outward faces of the cover plates extend between adjacent edges of adjacent panels mounted within the connected frames and such that the panels are visible but the connectors between connected frames and the adjacent side members are concealed.

24. A method according to claim 18 wherein each of the cover plates has an inward face comprising one or more tabs, and the side members of the connected frames comprise one or more corresponding tabs, and wherein mounting the cover plates over the adjacent side members of the connected frames comprises sliding the cover plates over the adjacent side members such that the tabs of the cover plates engage the corresponding tabs of the side members.

25. A method according to claim 18 comprising mounting a dust cover over top of the connected frames.

26. A method according to claim 25 comprising fastening the dust cover over top of the connected frames so as to prevent upward movement of any of the panels, connectors and cover plates relative to the frames.

27. A modular exhibit structure kit comprising: a plurality of open frames, each frame comprising an upper rail, a lower rail, and two side members extending perpendicularly between the upper rail and the lower rail, wherein an inner face of each side member has an indentation in a direction away from the other side member of the frame;

a plurality of elongate connectors configured to connect together one of the side members of each of the frames with one of the side members of an adjacent frame, wherein each one of the connectors has an elongate slot for receiving a corresponding elongate hook of the one of the side members of an adjacent frame and the connectors are slidable along a length of each of the adjacent side members of connected frames; a plurality of panels, each panel configured to fit between the two side members of one of the frames; and a plurality of cover plates configured to be removably mounted over the adjacent side members of the frames when connected; wherein the indentations in the side members of each frame are configured to provide a gap between the side members of the frame and sides of one of the panels when mounted within the frame, sufficient to allow a person to grip the sides of the panel and wherein the sides of each panel is provided with a recessed hand-hold at a location corresponding to the indentations to facilitate lifting and inserting each panel.

28. A modular exhibit structure kit according to claim 27 wherein each panel comprises a first groove along a first end face, the first groove configured to directly engage the upper rail of one of the frames, and a second groove along a second end face, the first and second end faces located at opposite ends of the panel, the second groove configured to directly engage the lower rail of one of the frames.

29. A modular exhibit structure kit according to claim 27 wherein each side member comprises a plurality of hooks spaced apart along the side member and extending outward from the side member in a direction away from the other side member of its frame, and wherein each connector comprises two or more connecting faces each having a slot configured to engage one of the hooks.

30. A modular exhibit structure kit according to claim 29 wherein the connecting faces of one or more of the connectors comprise outer and inner walls having aligned outer and inner slots respectively, the outer slot configured to engage a base portion of one of the hooks and the inner slot configured to engage an outwardly-extending portion of the hook.

31. A modular exhibit structure kit according to claim 27 wherein each of the side members comprises one or more tabs and each of the cover plates has an inward face comprising one or more corresponding tabs each configured to engage the one or more tabs of the side members.

32. A modular exhibit structure kit according to claim 27 comprising a dust cover configured to be removably mounted over top of the frames when connected.

33. A modular exhibit structure kit according to claim 27 comprising one or more shelves configured to be removably attached to one or more of the panels.

34. A modular exhibit structure kit according to claim 27 wherein each of the two side members comprises a central outer section connected between upper and lower inner sections, and wherein the indentation is formed between the upper and lower inner sections and the indentation is spanned by the central outer section.

* * * * *